US008497108B2

(12) United States Patent
Shastri

(10) Patent No.: US 8,497,108 B2
(45) Date of Patent: Jul. 30, 2013

(54) DIESEL FUEL ADDITIVE

(75) Inventor: Parshuram Nirajan Shastri, Inglewood, CA (US)

(73) Assignee: Aarna Scientific Trust (IN)

( * ) Notice: Subject to any disclaimer, the term of this patent is extended or adjusted under 35 U.S.C. 154(b) by 61 days.

(21) Appl. No.: 13/173,664

(22) Filed: Jun. 30, 2011

(65) Prior Publication Data

US 2012/0000115 A1 Jan. 5, 2012

Related U.S. Application Data

(60) Provisional application No. 61/360,880, filed on Jul. 1, 2010.

(51) Int. Cl.

| | |
|---|---|
| ***C12N 9/02*** | (2006.01) |
| *C10L 1/10* | (2006.01) |
| *C10L 7/00* | (2006.01) |

(52) U.S. Cl.
USPC ..... 435/189; 44/265; 44/300

(58) Field of Classification Search
USPC ..... 435/189; 44/300, 265
See application file for complete search history.

(56) References Cited

U.S. PATENT DOCUMENTS

| | | | |
|---|---|---|---|
| 3,958,955 | A | 5/1976 | Gautreaux |
| 4,602,919 | A | 7/1986 | Jessup et al. |
| 2005/0072041 | A1 | 4/2005 | Guinther et al. |
| 2006/0175230 | A1 | 8/2006 | Zhou et al. |

FOREIGN PATENT DOCUMENTS

| | | | |
|---|---|---|---|
| JP | 57038890 | | 3/1982 |
| WO | WO 2005087901 | A2 * | 9/2005 |

OTHER PUBLICATIONS

International Search Report dated Feb. 9, 2012, for International Application No. PCT/US2011/042604.

* cited by examiner

*Primary Examiner* — Susan Hanley
(74) *Attorney, Agent, or Firm* — Knobbe Martens Olson & Bear LLP

(57) ABSTRACT

A diesel fuel additive and synthesis method therefore is disclosed herein. The diesel fuel additive may be used in internal combustion engines including those present in cars and trucks, and reduces fuel consumption and pollutant emissions while increasing power.

19 Claims, 1 Drawing Sheet

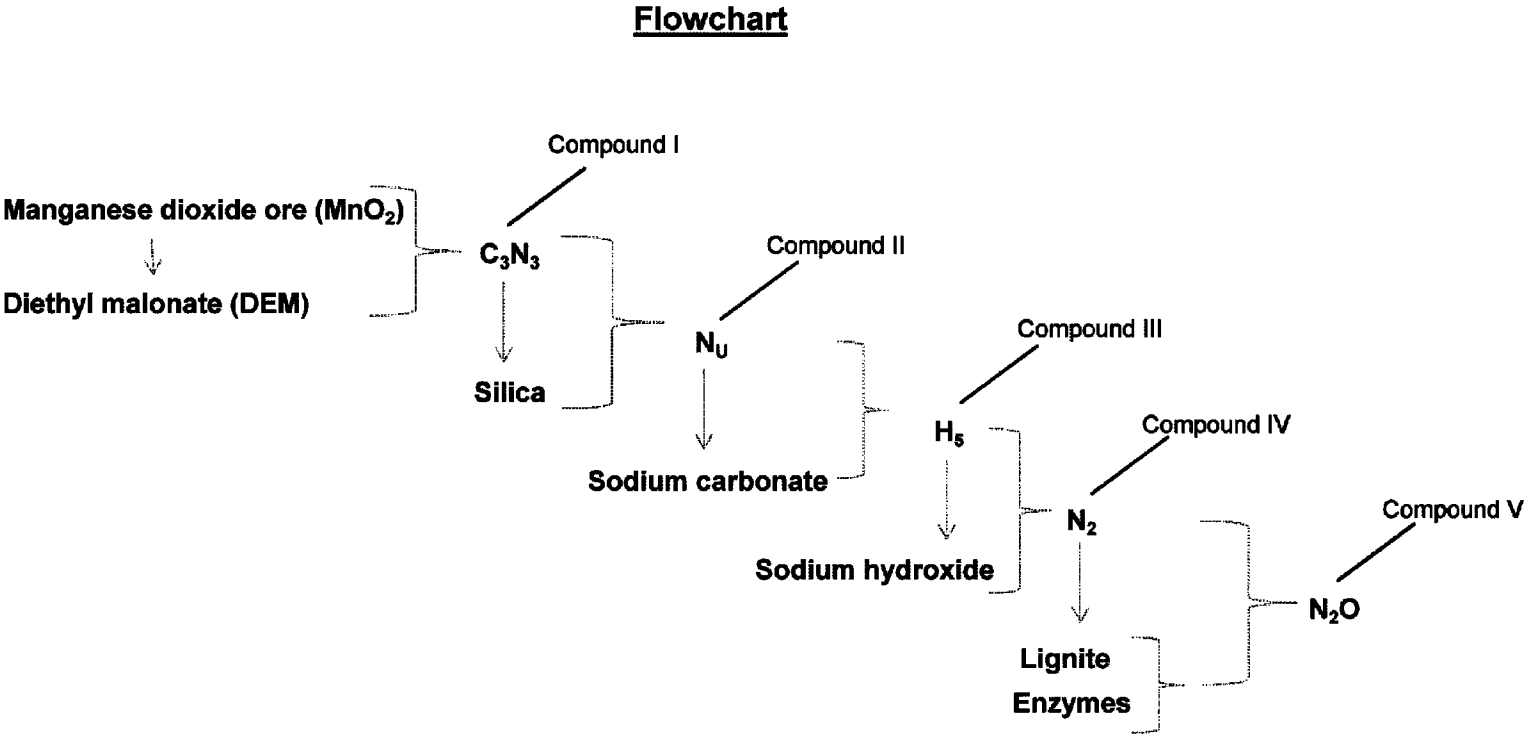
Flowchart
Manganese dioxide ore ($MnO_2$)
Diethyl malonate (DEM)
Compound I
$C_3N_3$
Silica
Compound II
$N_U$
Sodium carbonate
Compound III
$H_5$
Sodium hydroxide
Compound IV
$N_2$
Lignite
Enzymes
Compound V
$N_2O$

DIESEL FUEL ADDITIVE

CROSS-REFERENCE TO RELATED APPLICATIONS

This application claims priority to U.S. Provisional Application Ser. No. 61/360,880, filed Jul. 1, 2010, the contents of which are incorporated herein in their entirety.

BACKGROUND OF THE INVENTION

1. Field of the Invention

This invention relates to additives for use with diesel fuel, in particular diesel fuel used in internal combustion engines.

2. Description of the Related Art

Diesel fuel has been used for a long period of time, and, when used in internal combustion engines, confers many advantages when compared to gasoline. However, there is nonetheless room for improving the performance and characteristics of diesel fuel. Diesel fuel, when combusted, produces significant pollution, including particulate emissions. It would be advantageous to find a means by which these adverse effects can be minimized, in addition to improving the efficiency of diesel fuel combustion.

SUMMARY OF THE INVENTION

Some embodiments of the present invention are directed to a new additive for use with diesel fuel. When combined with diesel fuel used in internal combustion engines, including automobiles, this additive provides many advantages. These advantages include, but are not limited to, reducing combustion byproduct emissions, such as carbon dioxide, sulfur, and other pollutants, as well as reducing diesel fuel consumption.

Embodiments of the present invention, when used as an additive in diesel fuel, may be used in cars, trucks, power generators, and other machines using internal combustion engines. The additive is compatible with ordinary fuel systems and does not require any modification to an engine before use.

BRIEF DESCRIPTION OF THE DRAWINGS

FIG. 1 illustrates a flowchart describing a synthetic procedure for production of an embodiment of the present invention.

DETAILED DESCRIPTION OF THE PREFERRED EMBODIMENT

The present invention comprises one or more compounds synthesized using a multi-step process. The compound or compounds resulting from this synthetic process, typically in the form of a powder or gel, constitute an additive that may then be added to diesel fuel, including petrodiesel and biodiesel fuel, although the additive could also be added to unleaded gasoline or other types of fuel as well. As will be explained in further detail below, this additive confers several benefits and advantages in the combustion of diesel fuel, for example in an internal combustion engine, compared to diesel fuel without an additive.

With reference to FIG. 1, the process for the synthesis and preparation of a diesel fuel additive involves multiple steps and the creation of several precursor compounds before the final product is complete. In one embodiment, the ingredients used in the synthetic procedure can be added in proportions according to Table 1 below, in which the percentages indicated are based on 100% of the ingredients added to the diesel fuel additive.

The synthetic procedure involves the use of a manganese compound, preferably manganese dioxide, and more preferably as manganese dioxide ore which can be provided in powder form. The manganese dioxide ore can be obtained from many sources. One preferred source is manganese dioxide ore from India, which can provide an ore of 78% quality or purity. Variations in the quality or purity of the ore are acceptable, for example, ±2%, ±5%, ±8%, ±10%, ±12%, ±15%., or ±20%. Note that the amount of ore is preferably adjusted to maintain the percentage of manganese dioxide according to Table 1. Although the amount of manganese dioxide ore is 43% or about 43% in some embodiments, according to Table 1 below, other amounts may be appropriate, for example a range between about 42-44%, 40-46%, 35-50%, 25-50%, or 5-60%.

Diethyl malonate ("DEM") is then added to the ore. The amount of DEM may vary between an amount just barely sufficient to mix with the ore to approximately 20%, although in some embodiments, 9%, about 9%, between about 8-10%, 6-12%, or 5-15% is used. While mixing, the mixture is heated, in some embodiments only slightly such as 75-120° F., or to 95° F. This can be accomplished, for example, in a steam boiler. The mixing is continued for a relatively short period of time such as about 25-105 minutes, or about 65 minutes. The resulting compound is Compound I, which may appear as a light brown or brownish color.

Silica is then added to Compound I, and this may then be mixed for a relatively short period of time, for example about 5 to 55 minutes, or about 25 minutes. Other silicon compounds, including silicates and silicon, may be used as well. The amount of silica used can range in some cases of no more than about20%, or no more than aboutl0%, or sometimes between about 5-10%, or around 3.5%. While mixing, the mixture is preferably heated, such as from 80° F. to 130° F., or to 95° F. After cooling to room temperature such as between 60° F. to 75° F., the resulting mixture forms a neutral colloid, or Compound II. Compound II usually presents as a very light brown or sandy color. Compound II is then mixed with a carbonate, for example sodium carbonate in powder form, and with or without heating (for example, at room temperature) for a short period of time such as 5-60 minutes, such as about 15 minutes, so as to form Compound III, which may appear red or red-tinted. The sodium carbonate can be, for example, in the range of about 7%, between about 5-15%, or no more than about 20%, 15%, or 10%.

Next, a base, such as a strong base such as sodium hydroxide in aqueous solution, in some embodiments at a concentration of 48%, 45-50%, 40-60%, or 30-70%, may be added and mixed with Compound III. The mixture is preferably mixed for a short period of time, such as 5-45 minutes, or 35 minutes, at a relatively low temperature, for example room temperature such as between 60° F. to 75° F. The percentage of sodium hydroxide may vary, for example between 1% and 10%, or between 1% and 5%, but is preferably around 2.5%. At this point, Compound IV is formed as a powder, and is usually reddish or red-tinted in color.

Lignite powder is then added to Compound IV and blended during a relatively brief time interval, for example from 1-15 minutes, or 10 minutes. Although lignite powder is preferably used, other hydrocarbon and carbon compounds such as anthracite or other grades of coal may be suitable as well. The blending can occur in some embodiments at room temperature or some other similarly low temperature, such as between 60° F. to 75° F., or less than about 75° F. Preferably, the lignite powder is of a higher grade, for example greater than 55%, 60%, 65%, 70%, 75%, or more and may be obtained from India. A grade of 55%±1.2% has been found to perform acceptably, although other grades may also be possible. Preferably, the lignite is black in color. The weight of lignite added may range between 1-20% of the final product, such as between 5-10%, or 3%. Enzymes, such as one, two, or more oxidoreductases, including dehydrogenases or oxidases, are then added to the above mixture. The enzymes preferably include a mixture of EC 1.18 enzymes (enzymes acting on iron-sulfur proteins as donors) and EC 1.1 enzymes (enzymes acting on the CH—OH group of donors). The EC codes correspond to the classification nomenclature set forth by the Enzyme Commission, now published by the International Union of Biochemistry and Molecular Biology at Enzyme Nomenclature 1992 [Academic Press, San Diego, Calif., ISBN 0-12-227164-5 (hardback), 0-12-227165-3 (paperback)] with Supplement 1 (1993), Supplement 2 (1994), Supplement 3 (1995), Supplement 4 (1997) and Supplement 5 (in Eur. J. Biochem. 1994, 223, 1-5; Eur. J. Biochem. 1995, 232, 1-6; Eur. J. Biochem. 1996, 237, 1-5; Eur. J. Biochem. 1997, 250; 1-6, and Eur. J. Biochem. 1999, 264, 610-650; respectively), all of which are hereby incorporated by reference in their entireties. EC 1.1 enzymes can include those with NAD or NADP as an acceptor (EC 1.1.1, e.g., alcohol dehydrogenase), with a cytochrome as an acceptor (EC 1.1.2, e.g., lactate dehydrogenase), with oxygen as an acceptor (EC 1.1.3, e.g., alcohol oxidase), with a disulfide as an acceptor (EC 1.1.4, e.g., vitamin-K-epoxide reductase), with a quinine or similar compound as an acceptor (EC 1.1.5, e.g., quinoprotein glucose dehydrogenase), or with other acceptors (EC 1.1.99). EC 1.18 enzymes can include rubredoxin-NAD+ reductase, ferredoxin-NADP+ reductase, ferredoxin-NAD+ reductase, rubredoxin-NAD(P)+ reductase, or nitrogenases for example. These enzymes may be purchased from suppliers such as Advanced Enzyme Technologies Ltd. (Thane, India) or Microgenix Specialities Pvt. Ltd. (Gujarat, India). In some embodiments, the EC 1.18 enzymes make up 9% or about 9% of the product, and the EC 1.1 enzymes make up 8% or about 8% of the product. However, these enzymes may each be used in the range of, for example, less than about 25%, 20%, 15%, 12%, or 10%. This mixture is combined together, such as at a relatively low temperature such as room temperature, such as between 60° F. to 75° F., or less than about 75° F. until thoroughly blended. The mixture typically forms a powder, or Compound V, which may appear as a white, off-white, or pale yellow color. At this stage, among others, the powder may be used as a diesel fuel additive.

Optionally, a chelator such as diethylene triamine pentaacetic acid ("DTPA"), and an polar aprotic solvent such as dimethylformamide ("DMF"), both liquid, are mixed together in preferably approximately equal parts. Other chelators that may be used include ethylenediaminetetraacetic acid ("EDTA"). Other polar aprotic solvents that may be used include dimethyl sulfoxide ("DMSO"). As listed in Table I below, the DTPA and DMF together preferably form approximately 15% of the final product in equal 7.5% proportions in one embodiment; however, these ratios may be varied by reducing either the DTPA or DMF present by up to 2%, 3%, 3.5%, 4%, or 5%, as long as the amount of the corresponding DMF or DTPA is increased so that the total amount of the two materials equals approximately 15%, although the total amount could be, for example, between about 12-18%, 10-20%, or 5-25% in other embodiments. This DTPA/DMF mixture can then be added to Compound V and mixed until a gel forms. This resulting gel is another form of the diesel fuel additive, which can be used in the same manner as the powder.

The following Table I lists one non-limiting example of ingredients which may be used to create a diesel fuel additive according to the procedure illustrated above. The percentage values represent one potential preferred amount of each ingredient by mass that is added to create the final product. In the procedure listed above, purity or quality values may be listed, and the percentages listed below are based on the use of those ingredients at that given purity. The amounts of ingredients can thus be adjusted if the purity of a given ingredient is different. Other percentages, or ranges described elsewhere in the specification can also be utilized depending on the desired result. The final product could also include amounts of other compounds, such as a diluent for example, and the percentages listed below exclude percentages of those other compounds.

TABLE I

| Name of Products in Diesel Fuel Additive | Percentage |
|---|---|
| Manganese dioxide ore ($MnO_2$) | 43% |
| Diethyl malonate (DEM) | 9% |
| Silica ($SiO_2$) | 3.5% |
| Sodium carbonate (powder) ($Na_2CO_3$) | 7% |
| Sodium hydroxide (NaOH) | 2.5% |
| Lignite (powder) | 3% |
| Enzymes: | |
| EC 1.18 | 9% |
| EC 1.1 | 8% |
| Diethylene triamine pentaacetic acid (DTPA) | 7.5% |
| Dimethylformamide (DMF) | 7.5% |
| Total Percent | 100% |

Without wishing to be bound by theory, the diesel fuel additive produced according to the procedure set forth above is believed to function, once mixed with diesel fuel, by reacting with sulfur present in the fuel. This forms a first intermediate compound. When this first intermediate compound is then mixed with phenolic compounds present in the fuel, it creates a second intermediate compound. Subsequently, when the diesel fuel is combusted, typically in an internal combustion engine, the presence of this second intermediate compound makes the diesel fuel burn more cleanly and with fewer pollutants. Also, the presence of these intermediate compounds may provide additional power and reduce fuel consumption.

In order to use the diesel fuel additive, an amount of diesel fuel additive is added to a tank of diesel fuel. Only a small amount of diesel fuel additive may need to be added to obtain advantageous results. For example, one gram of diesel fuel additive powder per U.S. gallon of diesel fuel may be sufficient. Similarly, approximately 1.2 grams of diesel fuel additive gel per U.S. gallon of diesel fuel may be sufficient. In other embodiments, no more than about 10 grams, 9 grams, 8 grams, 7 grams, 6 grams, 5 grams, 4 grams, 3 grams, 2 grams, 1.8 grams, 1.6 grams, 1.4 grams, 1.2 grams, 1 gram, or less of diesel fuel additive gel or powder per U.S. gallon of diesel fuel is added to improve the diesel fuel. The diesel fuel additive may be added as either a powder (Compound V from the procedure above), or as a gel. Both the powder and the gel forms of the product can be provided in a diluent suitable for addition to diesel fuel.

Below are experimental results which demonstrate the uses and effectiveness of the diesel fuel additive described above.

EXAMPLE 1

A 1992 6.2 L medium-duty GMC diesel truck was tested by a professional testing service (Rod's Truck Repair, Santa Fe Springs, Calif.) using the diesel fuel additive described above. The truck had a baseline fuel consumption of 15.1 miles per gallon. To test the additive, the additive was mixed with two gallons of Chevron diesel fuel, which was then added to an additional 25 gallons of diesel fuel pumped into the truck.

The truck was then operated in typical stop-and-go traffic for a total of 419 miles. At this point, the fuel was drained from the truck's tank, and a total of 23 gallons of diesel fuel with additive was consumed. This yielded a fuel consumption of 18.2 miles per gallon, corresponding to a fuel mileage increase of 20.5%. Additionally, emissions were tested. Nitric oxide emissions were reduced by 26%, and the exhaust smoke opacity was reduced by 40%.

EXAMPLE 2

A long-term mileage test was conducted by the same testing service above using a 2005 Volvo tractor, with a baseline diesel fuel consumption of 5.24 miles per gallon, and a baseline smoke opacity of 5.35%. The truck was driven over 6439 miles (including mountainous terrain); over several tanks of fuel with additive added, the resulting average fuel consumption was calculated to be 7.61 miles per gallon. The smoke opacity was measured at 2.02%. This yields a fuel mileage improvement of 45% and a decrease in opacity of 62%.

EXAMPLE 3

Another test similar to Example 1 above was performed on a 2007 Peterbilt tractor, which had a baseline fuel consumption of 5.84 miles per gallon and a baseline smoke opacity of 10.6. After usage of the diesel fuel additive, average fuel consumption was calculated to be 8.88 miles per gallon, and opacity was calculated at 8.61. Thus, fuel mileage was improved by 52% and opacity was reduced by 19%.

Although certain embodiments of the disclosure have been described in detail, certain variations and modifications will be apparent to those skilled in the art, including embodiments that do not provide all the features and benefits described herein. It will be understood by those skilled in the art that the present disclosure extends beyond the specifically disclosed embodiments to other alternative or additional embodiments and/or uses and obvious modifications and equivalents thereof In addition, while a number of variations have been shown and described in varying detail, other modifications, which are within the scope of the present disclosure, will be readily apparent to those of skill in the art based upon this disclosure. It is also contemplated that various combinations or subcombinations of the specific features and aspects of the embodiments may be made and still fall within the scope of the present disclosure. Accordingly, it should be understood that various features and aspects of the disclosed embodiments can be combined with or substituted for one another in order to form varying modes of the present disclosure. Thus, it is intended that the scope of the present disclosure herein disclosed should not be limited by the particular disclosed embodiments described above. For all of the embodiments described above, the steps of any methods need not be performed sequentially.

What is claimed is:

1. A method of synthesizing a fuel additive, the method comprising the steps of:

combining a manganese compound with diethyl malonate to form a first compound;

adding a silicon compound to the first compound to form a second compound;

adding a carbonate to the second compound to form a third compound;

mixing a strong aqueous base with the third compound to form a fourth compound; and adding powdered lignite to the fourth compound, followed by adding one or more of EC 1.18 and EC 1.1 enzymes and blending to form a fuel additive.

2. The method of claim 1, wherein a chelator and an polar aprotic solvent are first mixed together and then combined with the fuel additive to form a fuel additive gel.

3. The method of claim 2, wherein the chelator comprises diethylene triamine pentaacetic acid and the polar aprotic solvent comprises dimethylformamide in an amount corresponding to 15% of the fuel additive gel.

4. The method of claim 1, wherein the first compound is formed by mixing together and heating manganese dioxide ore and diethyl malonate at a temperature between 75 and 120° F.

5. The method of claim 4, wherein the manganese dioxide ore comprises about 43% and diethyl malonate comprises about 9% of ingredients by mass based on total ingredients to make a fuel additive gel made by mixing the fuel additive with a chelator and a polar aprotic solvent.

6. The method of claim 1, wherein the second compound is formed by mixing together and heating silica and the first compound at a temperature between 80-130° F.

7. The method of claim 6, wherein the silica comprises about 3.5% of ingredients by mass based on total ingredients to make a fuel additive gel made by mixing the fuel additive with a chelator and a polar aprotic solvent.

8. The method of claim 1, wherein the third compound is formed by mixing together sodium carbonate and the second compound at room temperature.

9. The method of claim 8, wherein the sodium carbonate comprises about 7% of ingredients by mass based on total ingredients to make a fuel additive gel made by mixing the fuel additive with a chelator and a polar aprotic solvent.

10. The method of claim 1, wherein the fourth compound is formed by mixing together aqueous sodium hydroxide solution and the third compound at room temperature.

11. The method of claim 10, wherein the sodium hydroxide solution comprises about 2.5% of ingredients by mass based on total ingredients to make a fuel additive gel made by mixing the fuel additive with a chelator and a polar aprotic solvent.

12. The method of claim 1, wherein the EC 1.18 enzymes comprise about 9%, and the EC 1.1 enzymes comprise about 8% of ingredients by mass based on total ingredients to make, of a fuel additive gel made by mixing the fuel additive with a chelator and a polar aprotic solvent.

13. The method of claim 1, wherein the lignite comprises about 3% of ingredients by mass based on total ingredients to make a fuel additive gel made by mixing the fuel additive with a chelator and a polar aprotic solvent.

14. A method of making an improved diesel fuel, the method comprising the steps of:

obtaining a quantity of diesel fuel; and mixing the fuel additive of claim 1 with the diesel fuel.

15. The method of claim 14, wherein no more than about one gram of fuel additive is added per U.S. gallon of diesel fuel.

16. The method of claim 14, wherein the fuel additive is combined with an additional diluent prior to mixing with the diesel fuel.

17. The method of claim 14, wherein the fuel additive is mixed in a gel form by combining the fuel additive with a chelator and an polar aprotic solvent prior to adding the fuel additive to the diesel fuel.

18. The method of claim 17, wherein no more than about 1.2 grams of the gel form of the fuel additive is added per U.S. gallon of diesel fuel.

19. The method of claim 17, wherein the gel form of the fuel additive is combined with an additional diluent prior to mixing with the diesel fuel.

* * * * *